US008794124B2

(12) United States Patent
Iida et al.

(10) Patent No.: US 8,794,124 B2
(45) Date of Patent: Aug. 5, 2014

(54) HYDRAULIC PUMP OR MOTOR

(75) Inventors: Takeo Iida, Koga (JP); Tadashi Nakagawa, Mibu-machi (JP); Tomohiro Sakai, Oyama (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/809,671

(22) PCT Filed: Aug. 12, 2011

(86) PCT No.: PCT/JP2011/068441

§ 371 (c)(1), (2), (4) Date: Mar. 1, 2013

(87) PCT Pub. No.: WO2012/026348

PCT Pub. Date: Mar. 1, 2012

(65) Prior Publication Data

US 2013/0152777 A1 Jun. 20, 2013

(30) Foreign Application Priority Data

Aug. 26, 2010 (JP) ..... 2010-189839

(51) Int. Cl.

| | |
|---|---|
| ***F01B 3/02*** | (2006.01) |
| ***F01B 13/04*** | (2006.01) |
| ***F04B 1/30*** | (2006.01) |
| ***F04B 19/02*** | (2006.01) |
| ***F04B 27/06*** | (2006.01) |

(52) U.S. Cl.

USPC ..... 92/71; 91/503; 417/222.1; 417/466; 417/500; 417/534

(58) Field of Classification Search

USPC ..... 91/485, 503, 499; 92/71; 417/222.1, 417/222.2, 269, 271, 415, 439, 460, 461, 417/462, 466, 469, 471, 490, 500, 501, 521, 417/534

See application file for complete search history.

(56) References Cited

U.S. PATENT DOCUMENTS

| | | | | |
|---|---|---|---|---|
| 5,593,285 | A | 1/1997 | Watts | |
| 2005/0180872 | A1 * | 8/2005 | Esders | 417/509 |
| 2010/0236398 | A1 | 9/2010 | Iida | |

FOREIGN PATENT DOCUMENTS

| | | | |
|---|---|---|---|
| CN | 101802401 | A | 8/2010 |
| JP | 47-18005 | A | 9/1972 |
| JP | 09-317627 | A | 12/1997 |

(Continued)

OTHER PUBLICATIONS

International Search Report dated Nov. 15, 2011, issued for PCT/JP2011/068441.

*Primary Examiner* — Bryan Lettman

(74) *Attorney, Agent, or Firm* — Edwards Wildman Palmer LLP; James E. Armstrong, IV; Jonathon P. Western

(57) ABSTRACT

The present embodiments disclose an axial hydraulic pump including a residual pressure regenerating circuit (30) which is a pipe line communicating with a top dead center side communication port (31) and a bottom dead center side communication port (32). Further, the axial hydraulic pump includes cylinder ports (26-1 to 26-8) which are provided in the respective cylinder bores of the cylinder block (6) and are operated with the rotation of the cylinder block (6). Even further, the axial hydraulic pump includes communication holes (41-1 to 41-8) which communicate with the top dead center side communication port (31) and the bottom dead center side communication port (32).

6 Claims, 7 Drawing Sheets

(56) References Cited

FOREIGN PATENT DOCUMENTS

| | | | |
|---|---|---|---|
| JP | 2005-140035 | A | 6/2005 |
| KR | 10-2010-0058569 | A | 6/2010 |
| WO | WO-2009/037994 | A1 | 3/2009 |

* cited by examiner

A-A

HYDRAULIC PUMP OR MOTOR

FIELD

The present invention relates to an axial hydraulic pump or motor (a hydraulic pump or a hydraulic motor) capable of suppressing a pulsation generated when switching from a low-pressure process to a high-pressure process and/or switching from a high-pressure process to a low-pressure process.

BACKGROUND

Hitherto, as a construction machine or the like, an axial hydraulic piston pump which is driven by an engine or an axial hydraulic piston motor which is driven by a high-pressure hydraulic fluid has been widely used.

For example, the axial hydraulic piston pump includes a cylinder block which is provided so as to rotate along with a rotation shaft rotatably provided inside a casing and has a plurality of cylinders extending in the axial direction while being away from each other in the circumferential direction, a plurality of pistons which are slidably inserted and fitted into the respective cylinders of the cylinder block and move in the axial direction with the rotation of the cylinder block so as to suction or discharge a hydraulic fluid, and a valve plate which is provided between the casing and an end surface of the cylinder block and is provided with a suction port and a discharge port communicating with the respective cylinders. Then, when the driving shaft of the hydraulic pump is rotationally driven, the cylinder block rotates along with the operation shaft inside the casing and the pistons move in a reciprocating manner to the respective cylinders of the cylinder block so as to pressurize the hydraulic fluid suctioned from the suction port into the cylinder by the pistons so that the hydraulic fluid is discharged as a high-pressure hydraulic fluid to the discharge port.

Here, when the cylinder port of each cylinder communicates with the suction port of the valve plate, the piston moves in a direction in which the piston protrudes from the cylinder from the start end to the terminal end of the suction port, thereby performing a suction process of suctioning the hydraulic fluid from the suction port into the cylinder. Meanwhile, when the cylinder port of each cylinder communicates with the discharge port, the piston moves in a direction in which the piston advances into the cylinder from the start end to the terminal end of the discharge port, thereby performing a discharge process of discharging the hydraulic fluid inside the cylinder into the discharge port. Then, when the cylinder block rotates so that the suction process and the discharge process are repeated, the hydraulic fluid suctioned from the suction port into the cylinder by the suction process is pressurized by the discharge process so that the hydraulic fluid is discharged to the discharge port.

CITATION LIST

Patent Literature

Patent Literature 1: Japanese Laid-open Patent Publication No. 9-317627

Patent Literature 2: Japanese Laid-open Patent Publication No. 47-18005

SUMMARY

Technical Problem

Incidentally, the internal pressure of the cylinder bore, which suctions the hydraulic fluid through the suction port of the valve plate in the suction process using the above-described hydraulic pump of the related art, becomes low. When the cylinder port of each cylinder communicates with the discharge port, the high-pressure hydraulic oil inside the discharge port abruptly flows into the low-pressure cylinder bore through the cylinder port so as to cause a large pressure change, and pulsation is generated by the pressure change. As a result, vibration or noise is generated.

For this reason, in the hydraulic pump of the related art, the above-described pulsation is suppressed by providing an oil passageway communicating with a top dead center side confining region and a bottom dead center side confining region, where the top dead center side confining region is used to confine the oil inside the cylinder bore between the cylinder bore and the valve plate until the cylinder port communicates with the suction port after the communication between the cylinder port and the discharge port is disconnected, and the bottom dead center side confining region is used to confine the oil inside the cylinder bore between the cylinder bore and the valve plate until the cylinder port communicates with the discharge port after the communication between the cylinder port and the suction port is disconnected. Further, the efficiency is improved by reusing the residual pressure of the cylinder bore of the top dead center side confining region (see Patent Literatures 1 and 2).

However, since the above-described oil passageway (the residual pressure regenerating circuit) is just used for the communication or the accumulation of the pressure in the cylinder bore of the top dead center side confining region and the cylinder bore of the bottom dead center side confining region, discharge pulsation as a resonance state occurs in which the pressure of the hydraulic fluid moves plural times in a reciprocating manner inside the residual pressure regenerating circuit. As a result, there is a problem in which vibration or noise is generated by the residual pressure regenerating circuit.

The invention is made in view of the above-described circumstances, and it is an object of the invention to provide a hydraulic pump or motor capable of reducing discharge pulsation caused by a residual pressure regenerating circuit.

Solution to Problem

According to an aspect of the present inventions in order to solve the above problems and achieve the object, there is provided an axial hydraulic pump or motor in which a cylinder block having a plurality of cylinder bores formed around a rotation shaft slides on a valve plate with a high pressure side port and a low pressure side port and a reciprocating amount of a piston inside each cylinder bore is controlled by an inclination of a swash plate, the axial hydraulic pump or motor including: a communication hole which is formed in the cylinder block and is directed from the cylinder bore toward the valve plate; a top dead center side communication port which is formed in the valve plate and is formed in a top dead center side confining region as a region between an end of a valve plate suction port and an end of a valve plate discharge port at a top dead center side; a bottom dead center side communication port which is formed in the valve plate and is formed in a bottom dead center side confining region between the end of the valve plate suction port and the end of the valve plate discharge port at a bottom dead center side; and a residual pressure regenerating circuit which connects the top dead center side communication port to the bottom dead center side communication port, wherein the bottom dead center side communication port is provided at the bottom dead center side with a predetermined angular difference with respect to the position of the top dead center side communication port at the rotation advancing direction side of the cylinder block in relation to the line connecting the rotation shaft center.

According to the aspect of the present invention, there is provided the hydraulic pump or motor, wherein the top dead center side communication port is provided at a position where the top dead center side communication port communicates with the communication hole at a timing when the piston approaches the top dead center.

According to the aspect of the present invention, there is provided the hydraulic pump or motor, wherein the bottom dead center side communication port is provided at a position where the bottom dead center side communication port communicates with the communication hole at a timing when the piston approaches the bottom dead center.

According to the aspect of the present invention, there is provided the hydraulic pump or motor, wherein the top dead center side communication port and the bottom dead center side communication port are arranged in a concentric shape so that the radiuses of the concentric circles thereof are different from each other.

According to the aspect of the present invention, there is provided the hydraulic pump or motor, wherein the predetermined angular difference is an angular difference corresponding to a time obtained by dividing the length of the residual pressure regenerating circuit by a discharge pulsation propagation speed.

Advantageous Effects of Invention

According to the invention, the bottom dead center side communication port is provided at the bottom dead center side with a predetermined angular difference, for example, an angular difference corresponding to a time obtained by dividing the length of the residual pressure regenerating circuit by the discharge pulsation propagation speed with respect to the position of the top dead center side communication port at the rotation advancing direction side of the cylinder block in relation to the line connecting the rotation shaft center. Accordingly, since the hydraulic energy of the top dead center side is supplied toward the bottom dead center side by the residual pressure regenerating circuit, the efficiency of the hydraulic energy may be improved and the discharge pulsation caused by the residual pressure regenerating circuit may be reduced.

DESCRIPTION OF EMBODIMENTS

Figure 1:
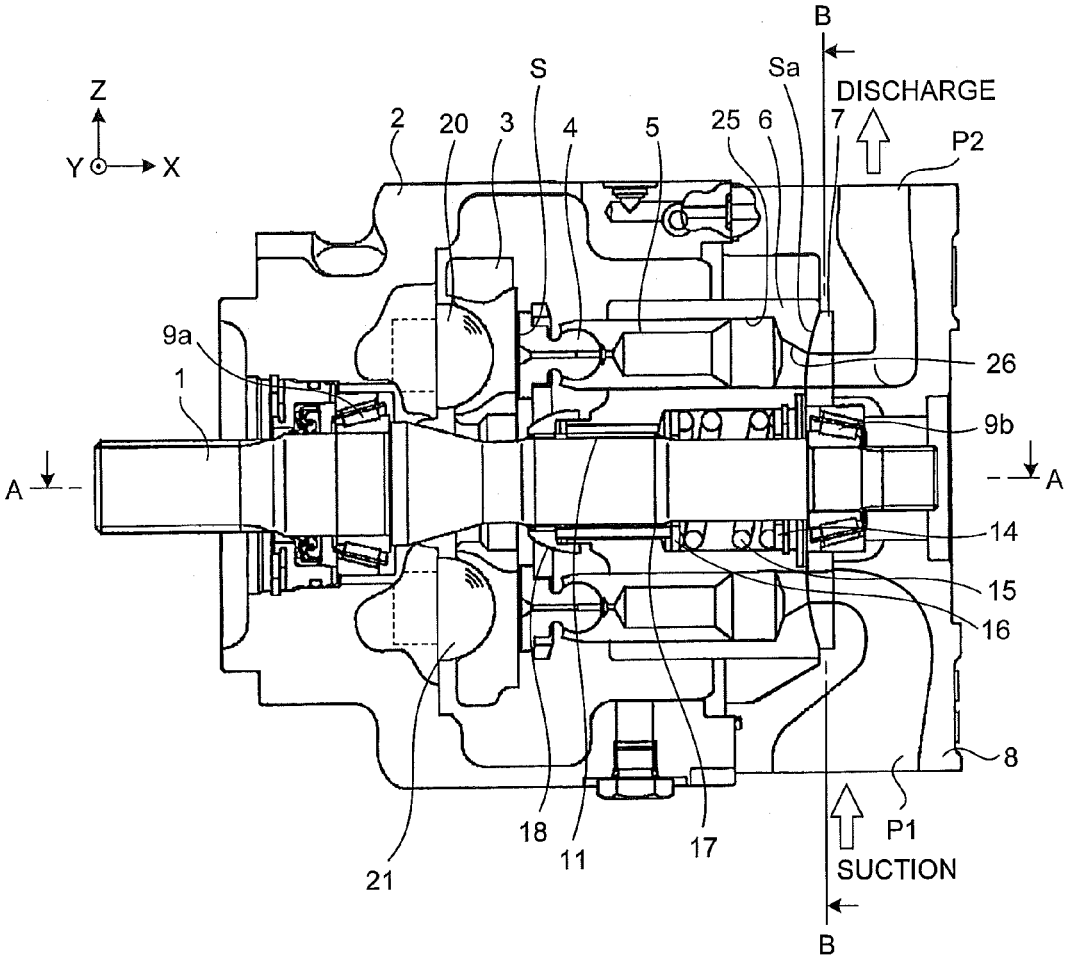
FIG. 1 is a cross-sectional view illustrating an outline configuration of a hydraulic pump according to a first embodiment of the invention.

Hereinafter, hydraulic pump or motor according to an embodiment of the invention will be described by referring to the drawings.

Figure 2:
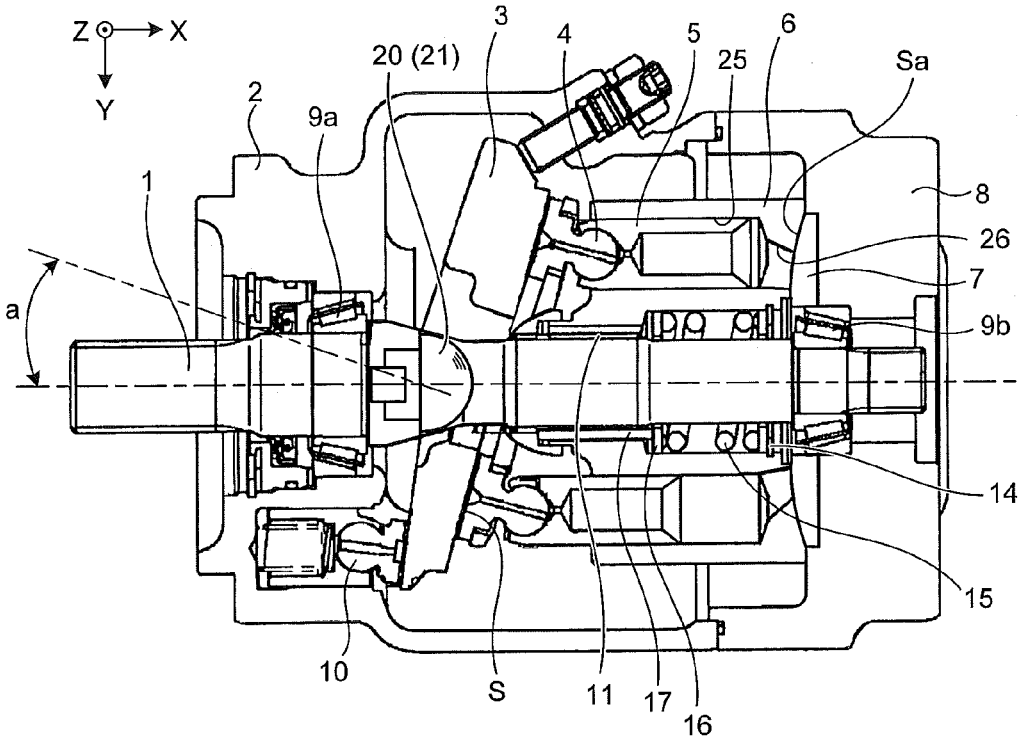
FIG. 2 is a cross-sectional view taken along the line A-A of the hydraulic pump illustrated in FIG. 1.

FIG. 1 is a cross-sectional view illustrating an outline configuration of a hydraulic pump according to the embodiment of the invention. Further, FIG. 2 is a cross-sectional view taken along the line A-A of the hydraulic pump illustrated in FIG. 1. The hydraulic pump illustrated in FIGS. 1 and 2 is a variable displacement hydraulic pump which converts an engine rotation and a torque transmitted to a shaft 1 into a hydraulic pressure and discharges oil suctioned from a suction port P1 as a high-pressure hydraulic fluid from a discharge port P2, where the amount of the hydraulic fluid discharged from the pump may be changed by changing an inclination angle a of a swash plate 3.

Hereinafter, the axis which follows the axis of the shaft 1 is set as the X axis, the axis which follows the inclination axis of the swash plate 3 is set as the Z axis, and the axis which is perpendicular to the X axis and the Z axis is set as the Y axis. Further, the direction which is directed from the input side end of the shaft 1 toward the opposite side end is set as the X direction.

The hydraulic pump includes the shaft 1 which is rotatably journaled to a casing 2 and an end cap 8 through bearings 9*a* and 9*b*, a cylinder block 6 which is connected to the shaft 1 through a spline structure 11 and rotates along with the shaft 1 inside the casing 2 and the end cap 8, and a swash plate 3. The cylinder block 6 is provided with a plurality of piston cylinders (cylinder bores 25) which are arranged at the same interval in the circumferential direction about the axis of the shaft 1 and are arranged in parallel to the axis of the shaft 1. A piston 5 which is movable in a reciprocating manner in parallel to the axis of the shaft 1 is inserted into each of the plurality of cylinder bores 25.

A recessed sphere with a spherical surface is provided in the front end of each piston 5 protruding from each cylinder bore 25. A spherical convex portion of a shoe 4 engages with the spherical recessed portion, and each piston 5 and each shoe 4 forms a spherical bearing. Furthermore, the spherical recessed portion of the piston 5 is caulked, so that the separation from the shoe 4 is prevented.

The swash plate 3 is provided between the side wall of the casing 2 and the cylinder block 6, and includes a flat surface S which faces the cylinder block 6. Each shoe 4 slides in a circular shape or an oval shape while being pressed against the sliding surface S with the rotation of the cylinder block 6 interlocked with the rotation of the shaft 1. A spring 15 which is supported by a ring 14 provided in the inner periphery of the cylinder block 6 in the X direction, a movable ring 16 and a needle 17 which are pressed by the spring 15, and an annular pressure member 18 which abuts against the needle 17 are provided around the axis of the shaft 1. By the pressure member 18, the shoe 4 is pressed against the sliding surface S.

The side wall of the casing 2 is provided with two semi-spherical bearings 20 and 21 which protrude so as to face the swash plate 3 are provided at symmetrical positions with the axis of the shaft 1 interposed therebetween. Meanwhile, the swash plate 3 at the side wall side of the casing 2 is provided with two recessed spheres corresponding to the arrangement positions of the bearings 20 and 21, and the bearing of the swash plate 3 is formed by the contact between the bearings 20 and 21 and two recessed spheres of the swash plate 3. The bearings 20 and 21 are arranged in the Z direction.

As illustrated in FIG. 2, the swash plate 3 is inclined in a plane perpendicular to the X-Y plane about the axis (the axis parallel to the Z axis) corresponding to the line connecting the bearings 20 and 21. The inclination of the swash plate 3 is defined by a piston 10 which moves in a reciprocating manner from the side wall side of the casing 2 while pressing one end of the swash plate 3 in the X direction. By the reciprocating movement of the piston 10, the swash plate 3 is inclined about the bearings 20 and 21 as a support point. The sliding surface S is also inclined by the inclination of the swash plate 3, and the cylinder block 6 rotates with the rotation of the shaft 1. For example, as illustrated in FIG. 2, when the cylinder block rotates in the counter-clockwise direction when seen from the X direction in a state where the inclination angle from the X-Z plane is a, each shoe 4 slides on the sliding surface S in a circular shape or an oval shape, so that the piston 5 inside each cylinder bore 25 moves in a reciprocating manner. When the piston 5 moves toward the swash plate 3, oil is suctioned from a suction port P1 into the cylinder bore 25 through a valve plate 7. When the piston 5 moves toward the valve plate 7, oil inside the cylinder bore 25 is discharged as a high-pressure hydraulic fluid from a discharge port P2 through the valve plate 7. Then, the volume of the hydraulic fluid discharged from the discharge port P2 may be controlled in a changeable manner by adjusting the inclination of the swash plate 3.

Here, the valve plate 7 fixed to the end cap 8 side and the rotating cylinder block 6 are bonded to each other through the sliding surface Sa. The end surface of the valve plate 7 at the side of the sliding surface Sa and the end surface of the cylinder block 6 at the side of the sliding surface Sa slide on each other by the rotation of the cylinder block 6.

Figure 3:
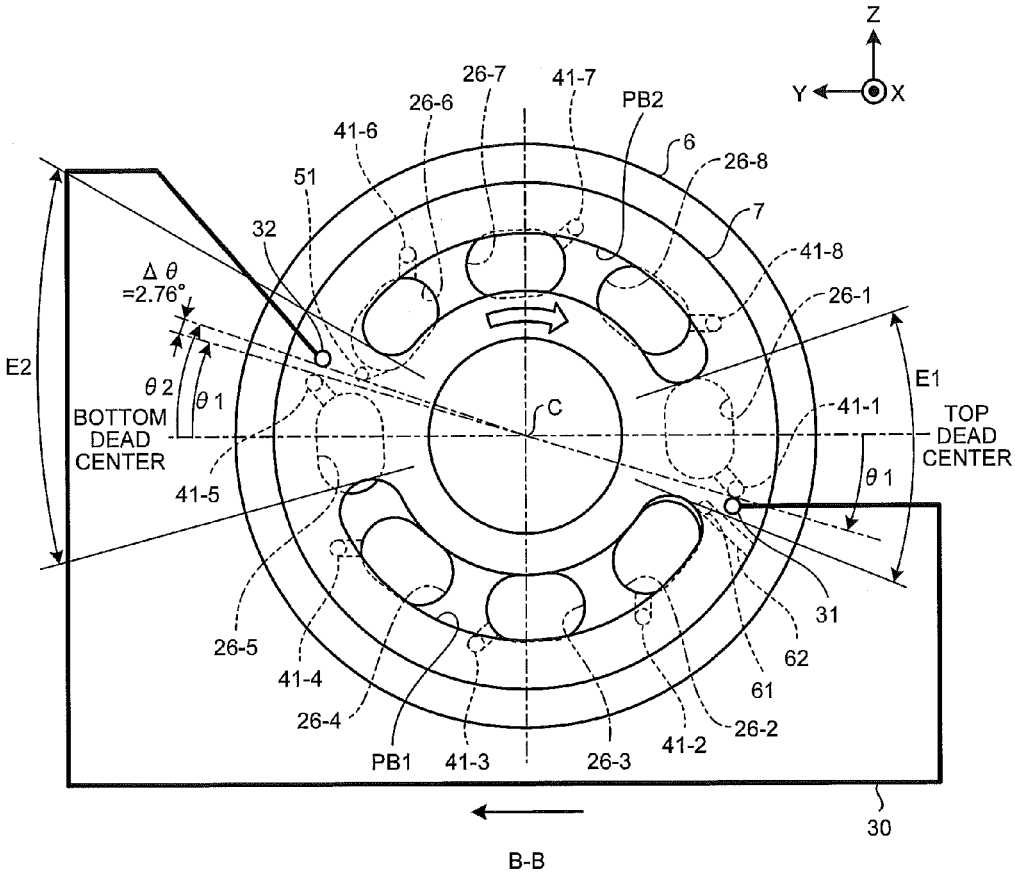
FIG. 3 is a cross-sectional view taken along the line B-B of the hydraulic pump illustrated in FIG. 1.

As illustrated in FIG. 3, the valve plate 7 includes a valve plate suction port PB1 which communicates with the suction port P1 and a valve plate discharge port PB2 which communicates with the discharge port P2. The valve plate suction port PB1 and the valve plate discharge port PB2 are provided on the same circular-arc, and are formed in a cocoon shape extending in the circumferential direction. Meanwhile, the cylinder block 6 at the side of the sliding surface Sa is provided with ports (cylinder port 26 (26-1 to 26-8)) of eight cylinder bores 25, through which the respective pistons 5 move in a reciprocating manner, are formed in a cocoon shape at the same interval on the same circular-arc where the valve plate suction port PB1 and the valve plate discharge port PB2 are arranged.

Here, when the cylinder block 6 rotates in the counter-clockwise direction when seen from the −X direction in FIG. 3, a discharge process is performed at the valve plate discharge port PB2 at the upper side of the drawing paper of FIG. 3 and a suction process is performed at the valve plate suction port PB1 at the lower side of the drawing paper thereof. Accordingly, in this case, the right end side of the drawing paper of FIG. 3 is switched from the discharge process to the suction process, so that the piston 5 inside the cylinder bore 25 reaches the top dead center closest to the sliding surface Sa. The left end side of the drawing paper of FIG. 3 is switched from the suction process to the discharge process, so that the piston 5 inside the cylinder bore 25 reaches the bottom dead center farthest from the sliding surface Sa. When the cylinder port 26 passes the top dead center, the cylinder bore 25 instantly changes from the high pressure state to the low pressure state. When the cylinder port 26 passes the bottom dead center, the cylinder bore 25 instantly changes from the low pressure state to the high pressure state. Further, in the vicinity of the top dead center, the cylinder port 26 does not communicate with any one of the valve plate discharge port PB2 and the valve plate suction port PB1, and a top dead center side confining region E1 is formed in which the hydraulic fluid inside the cylinder bore 25 is confined by the cylinder bore 25 and the valve plate 7. Furthermore, in the vicinity of the bottom dead center, the cylinder port 26 does not communicate with any one of the valve plate discharge port PB2 and the valve plate suction port PB1, and a bottom dead center side confining region E2 is formed in which the hydraulic fluid inside the cylinder bore 25 is confined by the cylinder bore 25 and the valve plate 7.

As illustrated in FIG. 3, the valve plate 7 is provided with a residual pressure regenerating circuit 30 which communicates with the cylinder port 26 inside the top dead center side confining region E1 and the cylinder port 26 inside the bottom dead center side confining region E2. The valve plate 7 of the top dead center side confining region E1 of the residual pressure regenerating circuit 30 is provided with a top dead center side communication port 31. Further, the valve plate 7 of the bottom dead center side confining region E2 of the residual pressure regenerating circuit 30 is provided with a bottom dead center side communication port 32. The top dead center side communication port 31 and the bottom dead center side communication port 32 are formed at the outer periphery other than the periphery through which the cylinder ports 26-1 to 26-8 pass. Further, the residual pressure regenerating circuit 30 is realized by the drill hole formed inside the end cap 8, and both ends thereof communicate with the top dead center side communication port 31 and the bottom dead center side communication port 32. Furthermore, the top dead center side communication port 31 and the bottom dead center side communication port 32 are provided on the same periphery of the valve plate 7.

Meanwhile, as illustrated in FIG. 3, the cylinder block 6 is provided with communication holes 41 (41-1 to 41-8) which correspond to the respective cylinder ports 26-1 to 26-8 so as to communicate with the top dead center side communication port 31 and the bottom dead center side communication port 32 with the rotation of the cylinder block 6.

FIG. 3 illustrates a state immediately before the cylinder port 26-1 inside the top dead center side confining region E1 communicates with the top dead center side communication port 31. Then, when the center of the cylinder port 26-1 is positioned at the top dead center, the communication hole 41-1 completely communicates with the top dead center side communication port 31. Meanwhile, when the center of the cylinder port 26-5 is positioned at the bottom dead center inside the bottom dead center side confining region E2, the communication hole 41-5 completely communicates with the bottom dead center side communication port 32.

Here, an angle θ1 from the position immediately before the communication hole 41-1 passes the top dead center to the position immediately before the communication hole communicates with the top dead center side communication port 31 is smaller than an angle θ2 from the position immediately before the communication hole 41-5 passes the bottom dead center to the position immediately before the communication hole communicates with the bottom dead center side communication port 32. Then, an angular difference Δθ between the angle θ2 and the angle θ1 may be obtained by the corresponding time difference Δt from the time where the communication hole 41-1 communicates with the top dead center side communication port 31 to the time where the communication hole 41-5 communicates with the bottom dead center side communication port 32. The time difference Δt is obtained by $\Delta t = L/V$, where the length of the pipe line of the residual pressure regenerating circuit 30 is denoted by L (m) and the pulsated propagation speed of the hydraulic fluid is denoted by V (m/sec). For example, when L=0.3 m and V=1300 m/sec, Δt=2.3×10^(−4). When the angular difference Δθ is obtained by using the time difference Δt while the rated rotation number R of the hydraulic pump is set to 2000 rpm, the following equation is used.

$$\Delta\theta = (R/60)\times 360^\circ \times \Delta t$$
$$= (2000/60)\times 360^\circ \times (2.3\times 10\hat{}(-4))$$
$$= 2.76^\circ$$

The Δθ becomes an angle at the timing when the hydraulic fluid is discharged from the top dead center side communication port 31 and the discharged hydraulic fluid first reaches the bottom dead center side communication port 32. That is, since the angular difference Δθ is set, a change in pressure inside the residual pressure regenerating circuit 30 is not resonated, and hence a discharge pulsation is reduced. Furthermore, since the residual pressure regenerating circuit 30 supplies the hydraulic energy at the top dead center side where the inside of the cylinder bore becomes a high pressure state into the cylinder bore at the bottom dead center side where the inside thereof becomes a low pressure state, it is possible to improve the efficiency of the hydraulic energy.

Furthermore, the top dead center side communication port 31 and the bottom dead center side communication port 32 are not needed inside the top dead center side confining region E1 and the bottom dead center side confining region E2, and may be provided at a position communicating with the cylinder port 26 when the cylinder port 26 exists inside the top dead center side confining region E1 and the bottom dead center side confining region E2. That is, in FIG. 3, the communication hole 41 is provided at the front outer periphery facing the rotation direction of the cylinder port 26, but the communication hole 41 may be provided at the rear outer periphery facing the rotation direction of the cylinder port 26. In this case, the top dead center side communication hole 31 is provided from the top dead center to the valve plate discharge port PB2. Here, as described above, the bottom dead center side communication port 32 is provided at a position which is late by the angular difference Δθ so that the top dead center side communication port 31 communicates with the communication hole 41 of the cylinder port 26 of the top dead center side confining region E1 and then communicates with the communication hole 41 of the cylinder port 26 of the bottom dead center side confining region E2.

Further, the positional relation between the top dead center side communication hole 31 and the bottom dead center side communication hole 32 is set so that the bottom dead center side communication port 32 is provided at the bottom dead center side with the angular difference Δθ with respect to the position of the top dead center side communication port 31 in the region of the rotation advancing direction of the cylinder block 6 in relation to the radius passing the rotation shaft center C.

Figure 4:
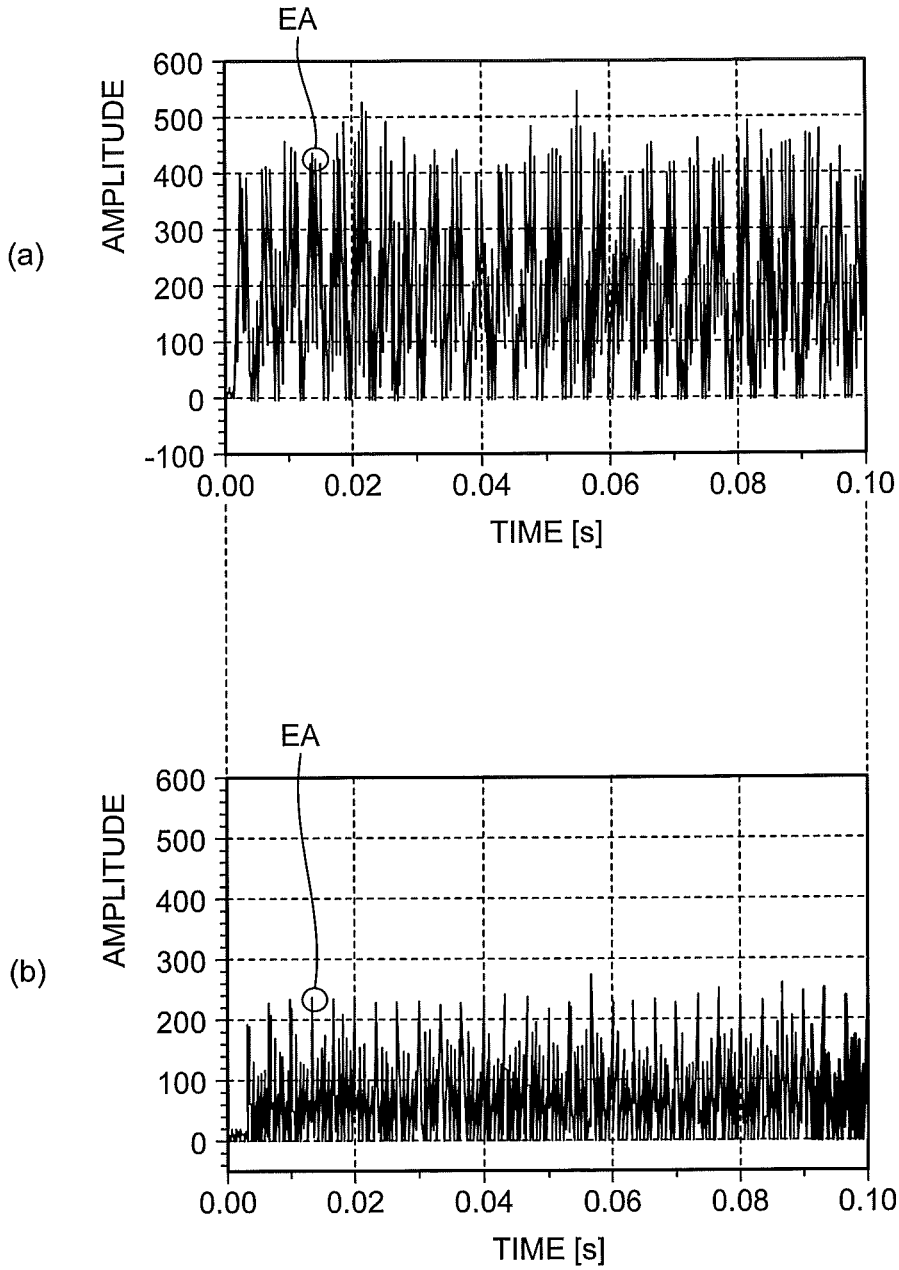
FIG. 4 is a diagram illustrating a change with time in the discharge pulsation generated in a residual pressure regenerating circuits of the related art and the first embodiment.

Here, FIG. 4 is a diagram illustrating a change with time of the discharge pulsation generated in the residual pressure regenerating circuits of the related art and the first embodiment. Furthermore, FIG. 4 is a model analysis simulation result by AMSEim. As illustrated in FIG. 4(*a*), in the case of the residual pressure regenerating circuit of the related art, for example, as illustrated in the region EA, discharge pulsation propagation which reciprocates three to four times occurs, so that the amplitude value is also large. On the contrary, as illustrated in FIG. 4(*b*), in the case of the residual pressure regenerating circuit 30 of the first embodiment, pulsation propagation occurs only once from the top dead center toward the bottom dead center, so that the amplitude value is very small.

Figure 5:
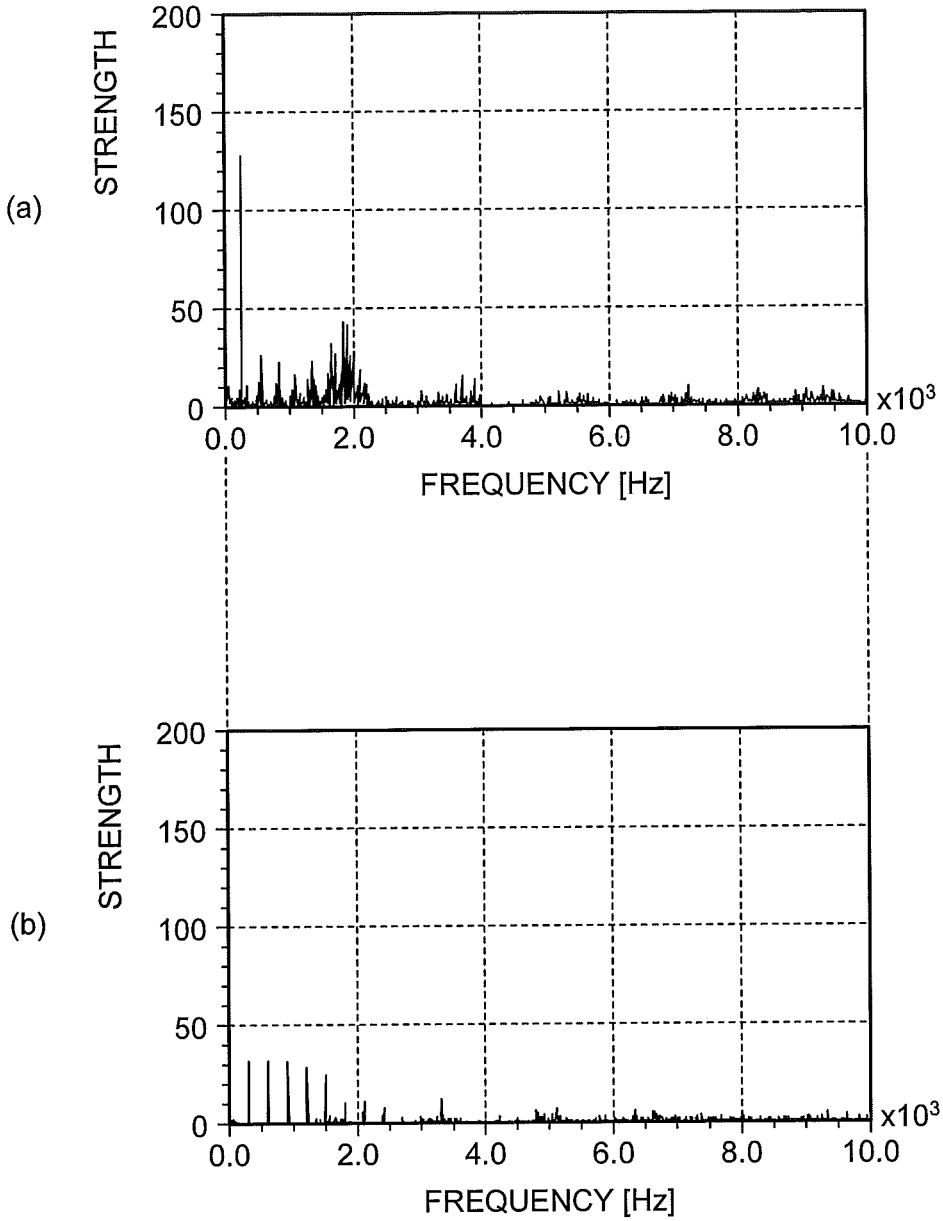
FIG. 5 is a diagram illustrating a spectrum of the discharge pulsation generated in the residual pressure regenerating circuits of the related art and the first embodiment.

Further, FIG. 5 is a diagram illustrating a spectrum of the discharge pulsation generated in the residual pressure regenerating circuits 30 of the related art and the first embodiment. Furthermore, FIG. 5 is a model analysis simulation result by AMSEim. As illustrated in FIG. 5(*a*), in the case of the residual pressure regenerating circuit of the related art, a spectrum which has a large amplitude value at the low frequency side occurs. On the contrary, in the residual pressure regenerating circuit 30 of the first embodiment, as illustrated in FIG. 5(*b*), a spectrum which has a large amplitude value at the low frequency side does not occur, so that the amplitude value throughout the frequency band is low. Accordingly, the discharge pulsation is reduced.

Furthermore, as illustrated in FIG. 3, the valve plate 7 is provided with a small-diameter communication hole 51 which communicates with the valve plate discharge port PB2 and the cylinder port 26 (the cylinder bore 25) inside the bottom dead center side confining region E2 immediately before the cylinder port 26 communicates with the valve plate discharge port PB2 in the periphery where the cylinder port 26 passes. The communication hole 51 increases the pressure inside the cylinder bore 25 immediately before the suction process is switched to the discharge process, whereby an abrupt increase in pressure generated during the switching operation is reduced and hence the generation of vibration or noise is suppressed. Furthermore, the center axis of the communication hole 51 is inclined in the outer peripheral direction from the lower portion of the inner peripheral side surface of the valve plate discharge port PB2 at the side of the cylinder port 26 and is inclined in the direction opposite to the rotation direction of a cylinder port 101.

Further, the valve plate 7 is provided with a drain port 61 which is provided at a position where the substantially normal pressure space formed between the valve plate 7 and the casing 2 communicates with the cylinder port 26 (the cylinder bore 25) inside the top dead center side confining region E1 immediately before the cylinder port 26 passes the valve plate suction port PB1 in the periphery where the cylinder port 26 passes. The drain port 61 communicates with the space of the valve plate 7 and the casing 2 from the sliding surface Sa of the valve plate 7 by a drill hole 62. By the drain port 61, the pressure inside the cylinder bore 25 generated when switching from the discharge process to the suction process is decreased.

Second Embodiment

Figure 6:
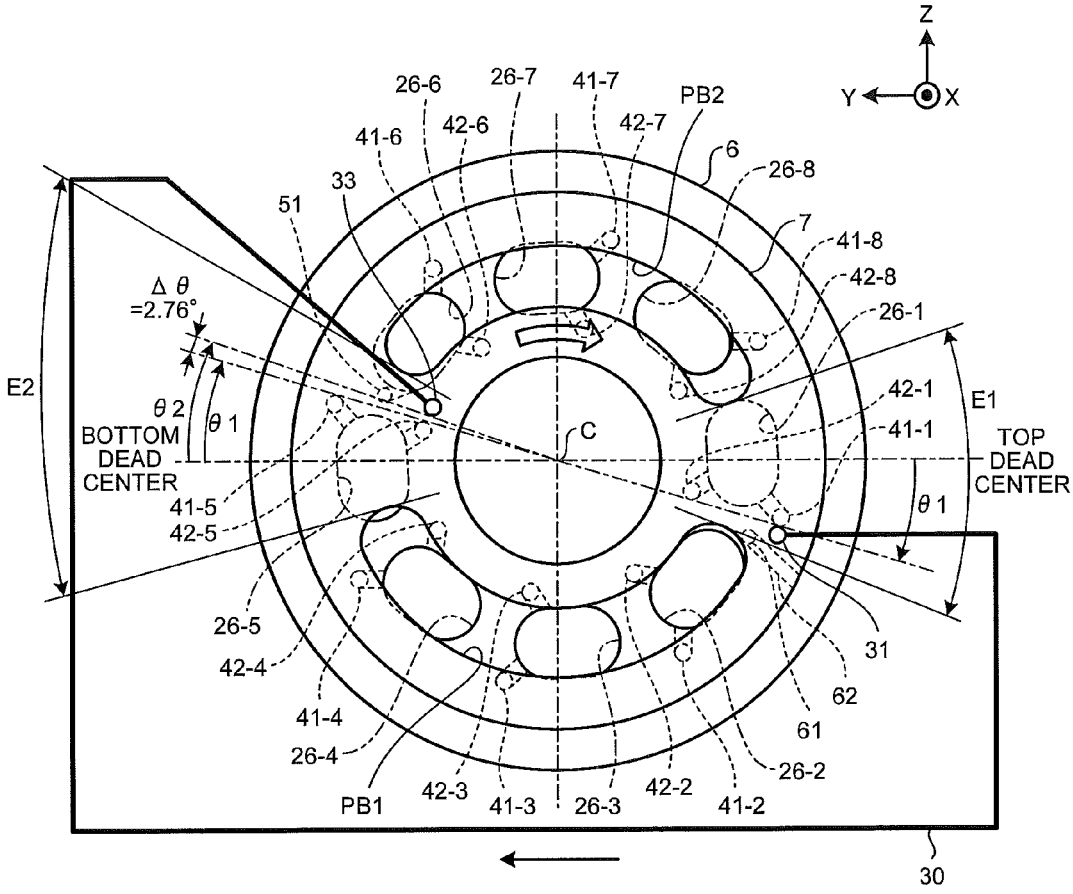
FIG. 6 is a diagram illustrating a configuration of a residual pressure regenerating circuit of a hydraulic pump according to a second embodiment of the invention.

Next, a second embodiment of the invention will be described. In the second embodiment, as illustrated in FIG. 6, a bottom dead center side communication port 33 is provided instead of the bottom dead center side communication port 32, and the bottom dead center side communication port 33 is provided at the inner periphery of the periphery where the cylinder ports 26-1 to 26-8 slide. Then, communication holes 42-1 to 42-8 which communicate with the bottom dead center side communication port 33 are provided in the respective cylinder ports 26-1 to 26-8. Further, both ends of the residual pressure regenerating circuit 30 are connected to the top dead center side communication port 31 and the bottom dead center side communication port 33. The respective cylinder ports 26-1 to 26-8 need the communication holes 42-1 to 42-8 in addition to the communication holes 41-1 to 41-8.

That is, the top dead center side communication port 31 and the bottom dead center side communication port 32 may not be provided so as to correspond to the respective communication holes 41-1 to 41-8 according to the first embodiment. Then, the top dead center side communication port 31 may be provided with respect to the communication holes 41-1 to 41-8 and the bottom dead center side communication port 33 may be provided with respect to the communication holes 42-1 to 42-8. That is, in FIG. 3, the top dead center side communication port 31 and the bottom dead center side communication port 32 are arranged in a concentric shape so that the radiuses of the concentric circles are equal to each other. In FIG. 6, the top dead center side communication port 31 is provided at the concentric circle at the outer periphery of the periphery where the cylinder ports 26-1 to 26-8 slide, and the bottom dead center side communication port 33 is provided at the concentric circle at the inner periphery of the periphery where the cylinder ports 26-1 to 26-8 slide. Here, as in the first embodiment, the position of the bottom dead center side communication port 33 needs to be late by the angular difference $\Delta\theta$ compared to the position of the top dead center side communication port 31. With such a configuration, the same operation and effect as those of the first embodiment may be obtained in the second embodiment.

Furthermore, in the above-described first and second embodiments, the hydraulic motor with eight cylinder bores 25, that is, even number of pistons is described. In the first and second embodiments, since it is easy to ensure much time for which the cylinder port 26 exists in both the top dead center side confining region E1 and the bottom dead center side confining region E2 when rotating the cylinder block 6 due to the even number of pistons, it is easy to form the top dead center side communication port 31 and the bottom dead center side communication ports 32 and 33 having the angular difference $\Delta\theta$ therebetween. However, even in the case of the hydraulic motor having an odd number of pistons, the first and second embodiments may be applied as in the case of the hydraulic motor having an even number of pistons when the top dead center side confining region E1 and the bottom dead center side confining region E2 are wide in the circumferential direction or many odd number of pistons are provided.

Figure 7:
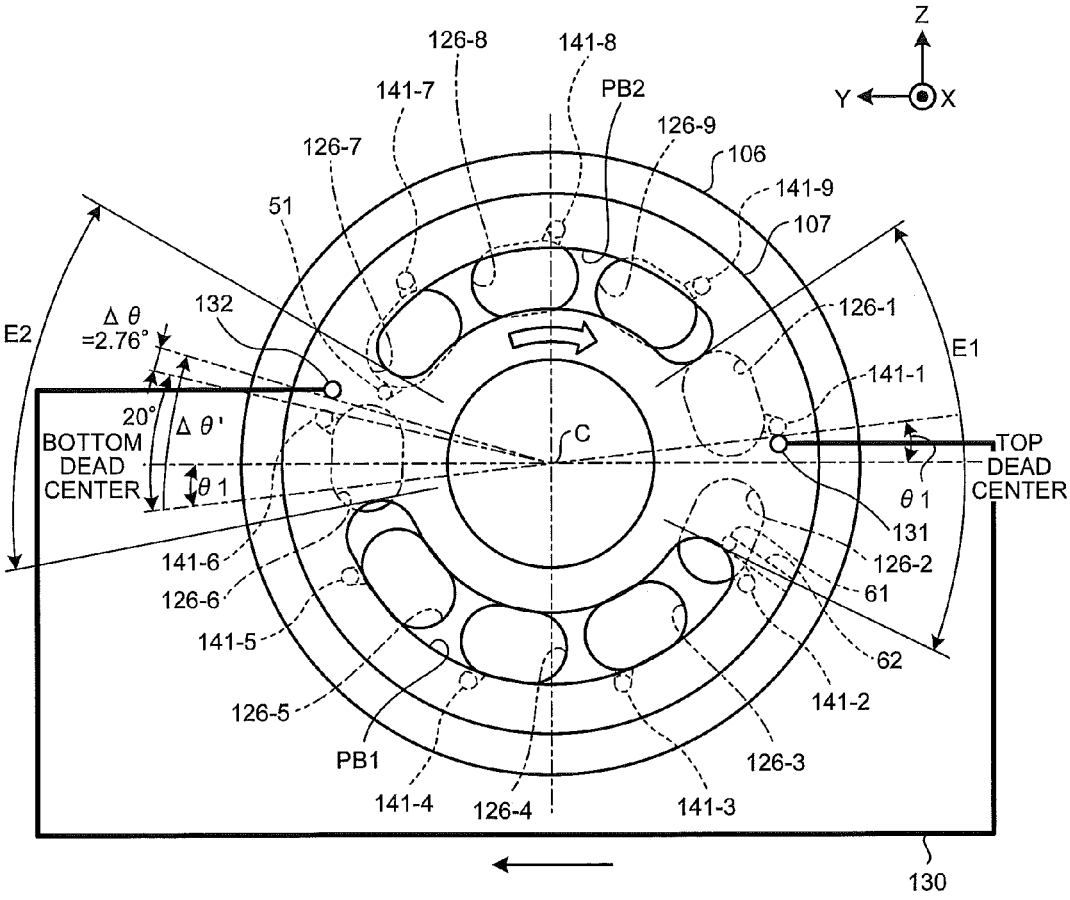
FIG. 7 is a cross-sectional view taken along the line B-B and illustrating a configuration of the residual pressure regenerating circuit of the hydraulic pump when the first embodiment of the invention uses an odd number of pistons.

For example, as illustrated in FIG. 7, the invention may be also applied to a cylinder block 106 having nine cylinder bores. The cylinder block 106 is provided with nine cylinder ports 126-1 to 126-9 and nine communication holes 141-1 to 141-9 corresponding to nine pistons. Then, both ends of a residual pressure regenerating circuit 130 corresponding to the residual pressure regenerating circuit 30 communicate with a top dead center side communication port 131 and a bottom dead center side communication port 132. Here, as in the first embodiment, the angular difference $\Delta\theta$ of the rotation of the cylinder block 106 from the angle where the hydraulic fluid is discharged from the top dead center side communication port 131 to the angle at the timing when the discharged hydraulic fluid first reaches the bottom dead center side communication port 132 through the residual pressure regenerating circuit 130 is set to 2.76°. Incidentally, since the cylinder block 106 is provided with nine cylinder bores as an odd number, the top dead center side communication port 131 and the bottom dead center side communication port 132 on a valve plate 107 are arranged with respect to the rotation shaft center C so as to have a half of the angular difference between the adjacent cylinder bores, and here an angular difference of 20° (360°/9/2). For example, as illustrated in FIG. 7, the bottom dead center side communication port 132 is provided at the bottom dead center side with an angular difference $\Delta\theta'$ ($=\Delta\theta+20°$) with respect to the position when the communication hole 141-1 of a cylinder port 141-1 communicates with the top dead center side communication port 131 at the rotation advancing direction side of the cylinder block 106 in relation to the line connecting the rotation shaft center C. In other words, when the angle $\theta 1$ is formed between the position when discharging the hydraulic fluid to the top dead center side communication port 131 and the top dead center, the position of the bottom dead center side communication port 132 has an angle of ($20°-\theta 1+2.76°$) in the rotation advancing direction from the top dead center.

Further, in the above-described first and second embodiments, the angular difference $\Delta\theta$ is set so that only pulsation propagation occurs once (in one direction), but the discharge pulsation may be reduced compared to the related art by setting the angular difference $\Delta\theta$ which prevents the pulsation reciprocating once or more. Since the angular difference $\Delta\theta$ is set, the length of the pipe line of the residual pressure regenerating circuit 30 may be shortened.

Further, in the above-described first and second embodiments, the radial width of the valve plate suction port PB1 is set to be substantially equal to the radial width of the cylinder port 26, and the radial width of the valve plate discharge port PB2 is set to be narrower than the radial width of the cylinder port 26. Accordingly, it is possible to maintain the hydraulic balance in the suction and the discharge.

In addition, in the above-described first and second embodiments, the hydraulic pump is exemplified. However, the invention is not limited thereto, and may be also applied to the hydraulic motor. In the case of the hydraulic motor, the high pressure side corresponds to the discharge side of the hydraulic pump, and the low pressure side corresponds to the suction side of the hydraulic pump.

Further, in the above-described embodiments, the swash plate type hydraulic pump or motor are exemplified. However, the invention is not limited thereto, and may be also applied to a clinoaxial hydraulic pump or motor.

REFERENCE SIGNS LIST

1 shaft
2 casing
3 swash plate
4 shoe
5, 10 piston
5*a* tapered surface
6, 106 cylinder block
7, 107 valve plate
8 end cap
9*a*, 9*b* bearing
11 spline structure
14 ring
15 spring
16 movable ring
17 needle
18 pressure member
20, 21 bearing
25 cylinder bore
26, 26-1 to 26-8, 126-1 to 126-9 cylinder port
30, 130 residual pressure regenerating circuit
31, 131 top dead center side communication port
32, 33, 132 bottom dead center side communication port
41-1 to 41-8, 42-1 to 42-8, 51, 141-1 to 141-9 communication hole
61 drain port
62 drill hole
P1 suction port
P2 discharge port PB1 valve plate suction port
PB2 valve plate discharge port
S, Sa sliding surface
E1, E2 confining region

The invention claimed is:

1. An axial hydraulic pump or motor comprising:

a cylinder block having a plurality of cylinder bores formed around a rotation shaft, configured to slide on a valve plate with a high pressure side port and a low pressure side port;

a plurality of cylinder ports of the plurality of cylinder bores;

a swash plate having an inclination for controlling a reciprocating amount of a piston inside each cylinder bore;

a plurality of communication holes which are formed in the cylinder block and are directed from the cylinder bores toward the valve plate, the plurality of communication holes being provided correspondingly to the plurality of cylinder ports, respectively;

a top dead center side communication port which is formed in the valve plate and is formed in a top dead center side confining region as a region between an end of a valve plate suction port and an end of a valve plate discharge port at a top dead center side;

a bottom dead center side communication port which is formed in the valve plate and is formed in a bottom dead center side confining region as an another region between the end of the valve plate suction port and the end of the valve plate discharge port at a bottom dead center side; and a residual pressure regenerating circuit for connecting the top dead center side communication port to the bottom dead center side communication port, the top dead center side communication port communicating to one of the plurality of communication holes in response to rotation of the rotation shaft, and the bottom dead center side communication port communicating to another one of the plurality of communication holes in response to rotation of the rotation shaft, wherein the bottom dead center side communication port is provided at the bottom dead center side with a predetermined angular difference with respect to the position of the top dead center side communication port at the rotation advancing direction side of the cylinder block in relation to the line connecting the rotation shaft center.

2. The hydraulic pump or motor according to claim 1, wherein the top dead center side communication port is provided at a position where the top dead center side communication port communicates with one of the plurality of communication holes at a timing when the piston approaches the top dead center.

3. The hydraulic pump or motor according to claim 1, wherein the bottom dead center side communication port is provided at a position where the bottom dead center side communication port communicates with one of the plurality of communication holes at a timing when the piston approaches the bottom dead center.

4. The hydraulic pump or motor according to claim 1, wherein the top dead center side communication port and the bottom dead center side communication port are arranged in a concentric shape so that the radiuses of the concentric circles thereof are different from each other.

5. The hydraulic pump or motor according to claim 1, wherein the predetermined angular difference is an angular difference corresponding to a time obtained by dividing the length of the residual pressure regenerating circuit by a discharge pulsation propagation speed.

6. The hydraulic pump or motor according to claim 1, wherein each of the plurality of cylinder bores substantially do not overlap the top dead center side communication port or the bottom dead center side communication port when one of the plurality communication holes communicates with the top dead center side communication port or the bottom dead center side communication port.

* * * * *